US010022769B2

(12) United States Patent
Radlmayr et al.

(10) Patent No.: US 10,022,769 B2
(45) Date of Patent: Jul. 17, 2018

(54) METHOD FOR PRODUCING A SHAPED PART FROM AN ALUMINUM ALLOY SHEET

(75) Inventors: Karl Michael Radlmayr, Linz (AT); Wolfgang Stall, Heubach (DE); Claudio Canalini, Geislingen (DE)

(73) Assignee: voestalpine Metal Forming GmbH, Krems an der Donau (AT)

( * ) Notice: Subject to any disclaimer, the term of this patent is extended or adjusted under 35 U.S.C. 154(b) by 836 days.

(21) Appl. No.: 13/264,855

(22) PCT Filed: Apr. 19, 2010

(86) PCT No.: PCT/AT2010/000120
§ 371 (c)(1),
(2), (4) Date: Jan. 9, 2012

(87) PCT Pub. No.: WO2010/118454
PCT Pub. Date: Oct. 21, 2010

(65) Prior Publication Data

US 2012/0090371 A1 Apr. 19, 2012

(30) Foreign Application Priority Data

Apr. 17, 2009 (EP) ..... 09450081
Apr. 19, 2010 (WO) ..... PCT/AT2010/000120

(51) Int. Cl.
*B21D 22/20* (2006.01)
*C22F 1/047* (2006.01)

(52) U.S. Cl.
CPC ..... *B21D 22/20* (2013.01); *B21D 22/208* (2013.01); *C22F 1/047* (2013.01)

(58) Field of Classification Search
CPC .... B21D 22/00; B21D 22/022; B21D 22/208; B21D 47/00; B21D 31/005; C21D 1/673; C21D 8/04
(Continued)

(56) References Cited

U.S. PATENT DOCUMENTS 4,193,285 A * 3/1980 Zumsteg ..... 72/348
4,324,596 A 4/1982 Wuebker
(Continued)

FOREIGN PATENT DOCUMENTS

CN 1753740 A 3/2006
DE 102008032911 * 3/2009
(Continued)

OTHER PUBLICATIONS

Tool and Manufacturing Engineers Handbook: Forming, Chapter 11—Shearing. By Charles Wick, John T. Benedict, and Raymond F. Veilleux. Published by Society of Manufacturing Engineers, Dec 10, 1984.*

Al-Mg Phase Diagram, https://data.epo.org/publication-server/image?imageName=imgaf001&docId=7314859; The diagram is posted in the Office Action. The link is only to a diagram.*

*Primary Examiner* — R. K. Arundale
*Assistant Examiner* — Pradeep C Battula

(57) ABSTRACT

A method for producing a shaped part from an aluminum sheet that includes an aluminum alloy, in particular an aluminum alloy of the 5000 series. The method includes introducing at least one aluminum sheet in a forming tool and cold-forming the aluminum sheet in the forming tool, and heating the cold-formed aluminum sheet at least once at least in some regions and at least once further metal forming the aluminum sheet. In order to create advantageous conditions for the method, it is proposed for the heated aluminum sheet to be subjected to the further metal forming step even before a temperature has been reached which the aluminum sheet has during the cold forming thereof.

10 Claims, 1 Drawing Sheet

(58) Field of Classification Search
USPC ..... 72/41, 43, 342.1, 342.2, 342.3, 342.4, 72/342.5, 342.6, 342.7, 342.94, 342.96, 72/347, 348; 148/550
See application file for complete search history.

(56) References Cited

U.S. PATENT DOCUMENTS

| | | | | | |
|---|---|---|---|---|---|
| 5,048,317 | A * | 9/1991 | Hirota et al. | 72/347 | |
| 5,388,330 | A * | 2/1995 | Daudi | B21D 53/26 | 29/894.323 |
| 6,550,302 | B1 * | 4/2003 | Ghosh | B21D 22/00 | 72/342.7 |
| 7,260,972 | B2 * | 8/2007 | Krajewski | B21D 22/022 | 72/342.5 |
| 7,730,753 | B2 * | 6/2010 | Krajewski et al. | 72/42 | |
| 2006/0130941 | A1 * | 6/2006 | Litalien et al. | 148/550 | |
| 2006/0230806 | A1 * | 10/2006 | Bohner et al. | 72/342.8 | |
| 2009/0235708 | A1 * | 9/2009 | Carter | B21D 22/02 | 72/57 |

FOREIGN PATENT DOCUMENTS

| | | | |
|---|---|---|---|
| DE | 102008032911 | A1 * | 3/2009 |
| DE | 102009031449 | A1 * | 3/2010 |
| EP | 0726106 | A1 | 8/1996 |
| EP | 1059363 | | 12/2000 |

* cited by examiner

METHOD FOR PRODUCING A SHAPED PART FROM AN ALUMINUM ALLOY SHEET

FIELD OF THE INVENTION

The invention relates to a method for producing a shaped part from an aluminum sheet composed of an aluminum alloy, in particular an aluminum alloy of the 5000 series, in which at least the aluminum sheet is inserted into a forming tool and cold-formed by it and in another step or other steps, the cold-formed aluminum sheet is heated at least once in at least some regions and is formed at least one more time.

BACKGROUND OF THE INVENTION

In order to be able to achieve a high deformation ratio with a simultaneously high strength of a shaped part, it is known from the prior art (DE 10 2008 032 911 A1) to subject an aluminum sheet first to a cold-forming at room temperature, then to an artificial aging, and finally to another cold-forming at room temperature. The purpose of the intermediate artificial aging step is to reduce the occurrence of strain hardening phenomena produced by the cold forming in order to thus ensure an increased deformation ratio. The disadvantage in this known method is its comparatively long processing time because in particular, the artificial aging—with its heating and subsequent cooling—is time-consuming. Such a method is unable to achieve rapid throughput times or a flexible adaptation in the number of shaped parts produced. In addition, an artificial aging in a furnace is comparatively cost-intensive and also takes up a lot of space, thus preventing an inexpensive manufacture of shaped parts.

It is also known from the prior art (EP 0 726 106 A1) for a work piece that has undergone a cold-forming step to then be placed into an autoclave for artificial aging. During this artificial aging, the work piece is brought into a creeping state by a press tool in order on the one hand to hold the work piece in a dimensionally stable fashion and on the other hand, to be able to even out any remaining contour imprecisions in the work piece and any internal stresses that could result in the occurrence of spring-back. This method is unable to achieve relatively short throughput times in the manufacture of a shaped part and is also unable to achieve high deformation ratios in the shaped part, particularly because the method requires the shaped part to yield beyond the yield point for the forming.

SUMMARY OF THE INVENTION

The object of the invention, therefore, is to improve a method of the type described at the beginning so that while achieving a high strength of the shaped part, it is also possible to achieve a rapid throughput time in the manufacture of the shaped part and a flexibly adaptable production output of shaped parts. This method should also achieve an inexpensive manufacture of shaped parts.

The invention attains this object in that the heated aluminum sheet is subjected to the additional metal-forming before it reaches a temperature that it had during its cold-forming.

If the heated aluminum sheet is subjected to the additional metal-forming before it reaches a temperature that it had during its cold-forming, then not only is it possible to shorten the time interval between the two forming steps and thus achieve comparatively short throughput times but it is also possible for this to not significantly reduce the strength of the shaped part as compared to other methods. In particular, the heating can be used to quite advantageous effect for recovering the structure of the aluminum alloy in order to counteract undesirable strain hardening phenomena. A person skilled in the art can achieve this quite easily by adjusting the parameters of time and/or temperature during the heating and possibly also by means of the time of a subsequent cooling. It is entirely possible for the parameters of the heating and cooling of the aluminum sheet not excluded by this to be selected or adjusted so that the heated and cold-formed aluminum sheet can be subjected to the additional metal-forming for example before it cools to room temperature. However, this does not exclude the possibility of heating and/or cooling the aluminum sheet multiple times before the additional forming; the only crucial requirement is for the heated aluminum sheet to be subjected to the additional metal-forming before it reaches a temperature that it had during its cold-forming. According to the invention, a method can now be achieved that combines the advantages—which were formerly at odds with each other in the prior art—of a short throughput time on the one hand and a comparatively high deformation ratio with a comparatively high strength on the other hand. To increase the deformation ratio, it is also conceivable for the cold-formed aluminum sheet that is heated in another step to be conveyed to the additional metal-forming without significant cooling and for the aluminum sheet to then be subjected to a semi-hot forming or warm forming below the recrystallization temperature of the aluminum alloy or to a hot forming above its recrystallization temperature. In any case, by avoiding an artificial aging, it is possible to achieve a method with which a comparatively continuous processing of aluminum sheet can be achieved. Methods of this kind are also referred to as "in-line" methods since they do not require any long storage times from the first processing step to the final shaped part. For this reason, the method according to the invention makes it possible, when manufacturing a shaped part with an aluminum alloy, to eliminate the comparatively large production areas that are required, for example, by a storage phase during artificial aging, thus also permitting an inexpensive manufacture. In addition, it is possible to eliminate an artificial aging furnace, as a result of which it is no longer necessary for the cold-formed aluminum sheets to be manufactured in large production runs, allowing the method according to the invention to achieve a flexibly adaptable production output. It should also be emphasized that the term "aluminum sheet" is also intended to include a flat, rolling mill-produced finished product composed of an aluminum material or an aluminum alloy.

If the aluminum sheet is shaped into a partial form of the shaped part by the cold forming and is shaped into the final form of the shaped part by the additional metal-forming, then it is possible to achieve increased deformation ratios in the shaped part because the aluminum sheet can be subjected to increased stresses by means of a heated additional metal-forming. In addition or alternatively to this, the cold forming can be begun with a reduced forming of the aluminum sheet to produce a partial form so that it is also possible to count on a reduced risk of producing strain hardening phenomena. In particular, the deformation ratio in the cold forming can be adjusted so that the heating and possibly cooling carried out in a subsequent step is/are sufficient to reduce strain hardening phenomena in the structure so that it is unnecessary to reckon with any significant change in strength.

An advantageous recovery of the structure after the cold forming can be achieved if the cold-formed aluminum sheet is heated to below the recrystallization temperature of the aluminum alloy, in particular to between 150 and 350 degrees Celsius.

If the aluminum sheet is provided with a temperature-resistant lubricant before the cold forming, then the method according to the invention makes it possible for the lubricant to be removed from the aluminum sheet in a step subsequent to the additional metal-forming. The applied lubricant can thus remain on the aluminum sheet during the method because its disintegration can be avoided by avoiding an artificial aging known from the prior art. It is thus possible to avoid cost-intensive and time-consuming cleaning steps because the lubricant is removed from the aluminum sheet in a step subsequent to the additional metal-forming. Lubricants and greases with a temperature resistance up to 350 degrees Celsius are known from the prior art.

Advantageous properties for the manufacture of the shaped part are achieved if the aluminum sheet is at least partially formed by means of deep drawing. It is likewise possible to form the aluminum sheet using a combination of deep drawing and stretch forming.

If the aluminum sheet is inserted into a forming tool for the additional metal-forming, then it is possible to achieve advantageous method conditions for the manufacture of the shaped part. In addition, it is possible for the forming tool that was already used in the cold forming to be used again, which can reduce costs. If the forming tool is heated, then this can reduce a possible cooling of the aluminum sheet.

If the cold-formed aluminum sheet is at least partially cut to length before and/or after the additional metal-forming, then this permits a particular precision of the shaped part produced by means of this.

BRIEF DESCRIPTION OF THE DRAWINGS

The figures show a sample sequence of the method according to the subject of the invention by way of example.

DETAILED DESCRIPTION OF THE PREFERRED EMBODIMENTS

Figure 1:
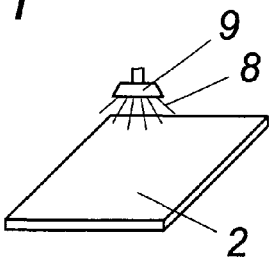
FIG. 1: shows a spraying of an aluminum sheet with lubricant.

The method according to the invention will be described in detail below in conjunction with FIGS. 1 through 6, which show an example in which it is used to manufacture a shaped part 1 shown in FIG. 7. FIG. 1 shows an aluminum sheet 2, which is composed of an aluminum alloy, for example of the 5000, 6000, or 7000 series; in FIG. 2, this sheet is subjected to a shape-changing procedure, in particular a deformation. In particular, the 5000 series has turned out to be particularly preferable since this alloy is comparatively strong and deformable and can easily be worked further. For a forming procedure, the aluminum sheet 2 is inserted into the forming tool 3 and in it, is cold formed at room temperature, in particular through deep-drawing. Then, the cold-formed aluminum sheet 2 is removed from the forming tool 3 and heated by means of a gas burner 4 schematically depicted in FIG. 4*a*. Other ways of heating the aluminum sheet 2 are conceivable and familiar to the person skilled in the art, e.g. it can be heated by means of a waffle iron, by infrared, laser, induction, ultrasound, and/or conductive methods. In general, the cold-formed aluminum sheet 2 can be entirely or partially heated; in the latter case, this can take place in or surrounding the regions of the aluminum sheet 2 that are subjected to the greatest stress by the forming procedure. Temperatures in the range from 150 and 350 degrees Celsius are conceivable, but the heating should be below the recrystallization temperature of the aluminum alloy. In another step shown in FIG. 5, the aluminum sheet 2 is then subjected to an additional metal-forming, or sheet metal-forming, procedure in a forming tool 5; this forming tool 5 can also be the forming tool 3 shown in FIG. 2. Here, too, the aluminum sheet 2 is deep-drawn with the aid of the forming tool 5. In order to meet particular requirements in the manufacture of the shaped part 1, in this additional metal-forming step shown in FIG. 5, at least part of the aluminum sheet 2 has a temperature that is increased relative to the temperature during the cold forming. This can be achieved in that before the heated, cold-formed aluminum sheet 2 cools to the temperature that it had during the cold forming shown in FIG. 2, the aluminum sheet 2 is subjected to the additional metal-forming step shown in FIG. 5. It is thus possible to achieve an "in-line" production method because the method according to the invention is not interrupted by the artificial aging known from the prior art. It is thus possible to react more quickly to customer demands with regard to the size of production runs and among other things, to avoid costly storage. In addition, the method according to the invention also makes it possible to produce an apparatus that requires less space because, for example, the comparatively large amount of space required for hit artificial aging can be eliminated.

Figure 2:
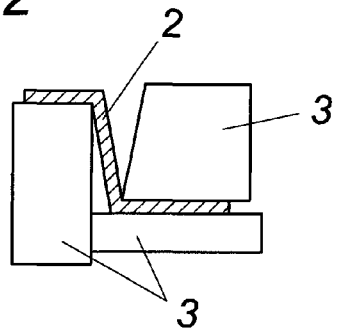
FIG. 2: shows a step of the cold forming of the aluminum sheet with a forming tool.

In order to reduce the amount of strain hardening phenomena during the first forming of the aluminum sheet 2 shown in FIG. 2, during the cold forming, the aluminum sheet 2 is first brought into a partial form 6 of the shaped part 1. Then, the aluminum sheet 2 or partial form 6 is brought into the final form 7 of the shaped part 1 by means of the additional metal-forming shown in FIG. 5. The difference between the forming procedures shown in FIGS. 2 and 5 can be recognized, for example, by the different heights of the left parts of the forming tools 3 and 5. It can thus be inferred from FIGS. 2 and 4 that the aluminum sheet 2 undergoes more forming in the additional metal-forming step than in the initial cold forming step; this makes it possible to produce less strain hardening phenomena in the initial cold forming step. The deformation ratios produced in the two forming steps, however, can also be reversed or equal, but this is not shown in the drawings.

Before the aluminum sheet 2 is cold formed, a temperature-resistant lubricant 8 is applied to it. To depict this method step, FIG. 1 shows a spray nozzle 9, by means of which the lubricant 8 can be applied to the aluminum sheet 2. Since the method according to the invention makes it possible to omit long processing steps such as those required by an artificial aging procedure, and by contrast with this, the aluminum sheet 2 can be formed into a shaped part 1 in a comparatively short amount of time, the lubricant 8—provided that it is sufficiently temperature-resistant—can remain on the aluminum sheet 2 until the last method step, without the risk of the lubricant 8 disintegrating. It is thus possible to avoid costly cleaning processes or even multiple applications of lubricant 8. By contrast with the prior art, it is thus conceivable to only remove the lubricant 8 from the aluminum sheet 2 in a step after the additional metal-forming shown in FIG. 5, for example in the step shown in FIG. 7.

Figure 4B:
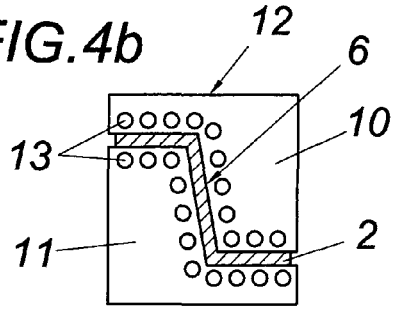
FIGS. 4*a* and 4*b* show alternative possibilities for heating the cold-formed aluminum sheet.

A particularly uniform and/or precisely positioned heating of the cold-formed aluminum sheet 2 can occur if it is inserted into mated dies 10, 11 of a heating tool 12 that at least partially coincide with the shape of the aluminum sheet 2; the heating tool 12 is depicted in FIG. 4*b*. Heating elements 13 are provided along the contour of the mated dies 10, 11, at the locations of the desired heating.

After the cold forming shown in FIG. 2, the cold-formed aluminum sheet 2 is inserted into a tool 14 for partially cutting it to length. This tool 14 can already be provided with means for heating the cold-formed aluminum sheet 2, but this has not been depicted in detail. This would make it possible, though, to eliminate the method step shown in FIGS. 4*a* and 4*b*.

Figure 5:
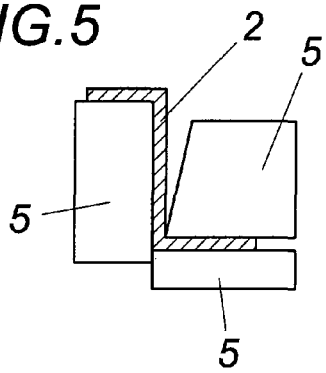
FIG. 5 shows an additional metal-forming of the heated aluminum sheet in a forming tool.
Figure 3:
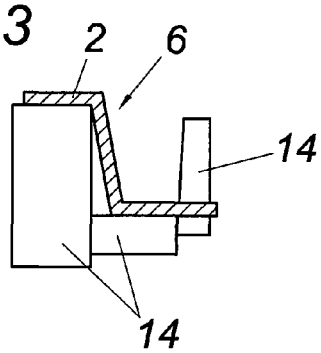
FIG. 3: shows a cutting of the cold-formed aluminum sheet with another tool.
Figure 6:
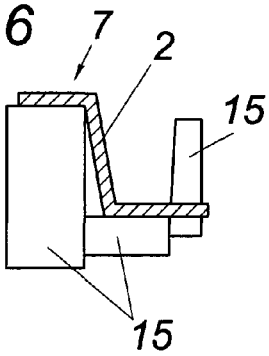
FIG. 6 shows a final cutting of the aluminum sheet with a tool to complete the process.
Figure 4A:
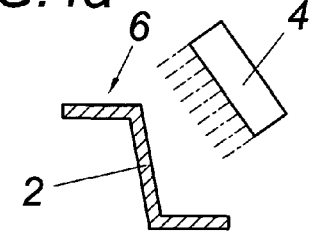
Figure 7:
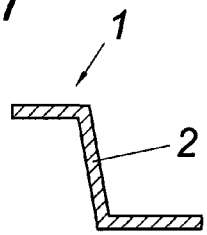
FIG. 7 shows the shaped part manufactured by the method.

After the additional metal-forming shown in FIG. 5, the final form 7 can be cut to length again, for which purpose it is inserted into a tool 15 in FIG. 6. This tool 15 can also be the same tool 14 from FIG. 3. Likewise, in this method step shown in FIG. 6 or in other method steps not shown, the final form 7 can be beveled and/or also optionally also provided with holes.

The invention claimed is:

1. A method for producing a shaped part from an aluminum sheet composed of an aluminum alloy, comprising:

performing a first sheet-metal-forming process by inserting the aluminum sheet into a forming tool and cold-forming the aluminum sheet in the forming tool, resulting in a cold-formed aluminum sheet;

subsequently heating the cold-formed aluminum sheet to below a recrystallization temperature of the aluminum alloy at least once in at least some regions; and performing an additional sheet-metal-forming process by metal-forming the heated, cold-formed aluminum sheet again at least one more time before the aluminum sheet reaches a temperature that the aluminum sheet had during its cold-forming step during the first sheet-metal-forming process.

2. The method as recited in claim 1, wherein the cold forming step during the first sheet-metal-forming process shapes the aluminum sheet into a partial form of the shaped part and the metal-forming step during the additional sheet-metal-forming process shapes the aluminum sheet into a final form of the shaped part.

3. The method as recited in claim 1, further comprising providing the aluminum sheet with a temperature-resistant lubricant before the cold-forming step during the first sheet-metal-forming process, and removing the lubricant from the aluminum sheet after the metal-forming step during the additional sheet-metal-forming process.

4. The method as recited in claim 1, comprising inserting the cold-formed aluminum sheet into a heated forming tool for the metal-forming step during the additional sheet-metal-forming process.

5. The method as recited in claim 1, wherein the aluminum sheet is at least partially metal-formed by deep drawing or by a combination of deep drawing and stretch forming during the cold-forming step of the first sheet-metal-forming process and during the metal-forming step of the additional sheet-metal-forming process.

6. The method as recited in claim 1, wherein in order to heat the cold-formed aluminum sheet, the cold-formed aluminum sheet is inserted into mated dies of a heating tool that at least partially coincide with the shape of the aluminum sheet.

7. The method as recited in claim 1, further comprising at least partially cutting to length the cold-formed aluminum sheet before and/or after the metal-forming step during the additional sheet-metal-forming process.

8. The method as recited in claim 1, wherein the aluminum alloy is of the 5000 series.

9. The method as recited in claim 1, comprising heating the cold-formed aluminum sheet to a temperature between 150 and 350 degrees Celsius.

10. The method as recited in claim 1, wherein, from the cold-forming step during the first sheet-metal-forming process to the metal-forming step during the additional sheet-metal-forming process, the aluminum sheet does not undergo an artificial aging.

* * * * *